US010179665B2

(12) United States Patent
Thieme et al.

(10) Patent No.: US 10,179,665 B2
(45) Date of Patent: Jan. 15, 2019

(54) PORTABLE CABLE TIE TOOL

(71) Applicant: HellermannTyton GmbH, Tornesch (DE)

(72) Inventors: Hans-Dieter Thieme, Uetersen (DE); Oliver Dohrmann, Uetersen (DE)

(73) Assignee: HELLERMANNTYTON GmbH (DE)

( * ) Notice: Subject to any disclaimer, the term of this patent is extended or adjusted under 35 U.S.C. 154(b) by 176 days.

(21) Appl. No.: 15/036,022

(22) PCT Filed: Oct. 14, 2014

(86) PCT No.: PCT/EP2014/072056
§ 371 (c)(1),
(2) Date: May 11, 2016

(87) PCT Pub. No.: WO2015/067444
PCT Pub. Date: May 14, 2015

(65) Prior Publication Data

US 2016/0280405 A1 Sep. 29, 2016

(30) Foreign Application Priority Data

Nov. 11, 2013 (DE) ..... 10 2013 222 924

(51) Int. Cl.
*B65B 13/02* (2006.01)
*B65B 13/22* (2006.01)
*B65B 57/00* (2006.01)

(52) U.S. Cl.
CPC ..... *B65B 13/027* (2013.01); *B65B 13/22* (2013.01); *B65B 57/00* (2013.01)

(58) Field of Classification Search
CPC ..... B65B 57/20; B65B 57/00; B65B 13/22; B65B 13/24; B65B 13/027; B65B 13/025; B65B 13/02
See application file for complete search history.

(56) References Cited

U.S. PATENT DOCUMENTS 4,610,076 A 9/1986 Ueda
4,790,225 A 12/1988 Moody et al.
(Continued)

FOREIGN PATENT DOCUMENTS

CN 101983159 A 3/2011
EP 0 432 477 6/1991
(Continued)

OTHER PUBLICATIONS

Merriam Webster Definition of "Strap", Sep. 2018.*
(Continued)

*Primary Examiner* — Pradeep C Battula
(74) *Attorney, Agent, or Firm* — Robert J. Myers

(57) ABSTRACT

A portable tool for tying an object, in particular a cable harness, using a strip, comprising a tool element with a cycle controller arranged in the tool element, a clamping device, and a drive for the clamping device. The drive is designed as a dual drive such that the cycle controller and the clamping device each have a dedicated drive, said drives being actuated independently by a controller. By providing a dedicated drive for the clamping device in this manner, interfering influences from the cycle controller are eliminated. Thus, a more precise clamping process can be carried out with high reproducibility, thereby improving the quality of the tying process.

17 Claims, 2 Drawing Sheets

(56) References Cited

U.S. PATENT DOCUMENTS

| | | | | |
|---|---|---|---|---|
| 5,050,649 | A | 9/1991 | Kurmis | |
| 5,595,220 | A | 1/1997 | Leban et al. | |
| 5,947,166 | A * | 9/1999 | Doyle | E04G 21/123 140/119 |
| 5,983,473 | A * | 11/1999 | Yuguchi | E04G 21/122 140/119 |
| 6,018,975 | A * | 2/2000 | Frigerio | B21C 1/12 72/280 |
| 7,966,866 | B2 * | 6/2011 | Hansma | A61B 5/0053 73/81 |
| 2002/0129866 | A1 | 9/2002 | Czebatul et al. | |
| 2009/0242069 | A1 | 10/2009 | Segroves | |
| 2010/0176766 | A1 | 7/2010 | Brandner et al. | |

FOREIGN PATENT DOCUMENTS

| | | | |
|---|---|---|---|
| EP | 0 839 717 | | 5/1998 |
| JP | 07089512 | A | 4/1995 |
| JP | 09156608 | A | 6/1997 |
| JP | 2002240804 | A | 8/2002 |
| JP | 2013000863 | A | 1/2013 |
| WO | 02074465 | A1 | 9/2002 |
| WO | 2009123837 | A1 | 10/2009 |

OTHER PUBLICATIONS

International Search Report and Written Opinion dated Jan. 5, 2015, directed to International Application No. PCT/EP2014/072056; 15 pages.

* cited by examiner

PORTABLE CABLE TIE TOOL

CROSS-REFERENCE TO RELATED APPLICATIONS

This application is a national stage application under 35 USC 371 of International Application No. PCT/EP2014/072056, filed Oct. 14, 2014, which claims priority to German Application No. 10 2013 222 924.0, filed Nov. 11, 2013, the entire contents of which are incorporated herein by reference.

FIELD OF THE INVENTION

The invention relates to a portable tool for tying an object, in particular a cable harness, by means of a strap, said portable tool having a tool body with a cycle controller disposed therein, and a tensioning installation and a drive therefor.

BACKGROUND OF THE INVENTION

In the case of known cable tie tools such as are known in principle from EP 0 428 116 A1, for example, a drive which actuates a cycle controller is provided. The latter serves for carrying out the various movements which have to be carried out by the cable tie tool in a controlled sequence in the context of an operating cycle. This includes in particular closing a gripping clamp of the tool, in which the strap for wrapping the object to be tied is guided, introducing the free strap end into the lock which is located at the rear strap of the former, and severing the projecting strap end, and finally opening the wrapping clamp.

These operational steps which have to be performed in a controlled sequence during the operating cycle also include tensioning the strap which is guided around the object to be tied by means of a tensioning installation. The latter serves for tightening the strap to a strap tension which is typically pre-determined. To this end, various types of tensioning installations are known, for example a tensioning installation having a tensioning roller which is provided with sharp teeth and engages in the surface of the strap which is composed of plastics (EP 0 432 477 A1). Once the strap reaches its pre-determined strap tension the traction force which is exerted by the teeth of the tensioning roller is no longer sufficient for onward movement, so that the strap is stationary and the teeth of the tensioning roller machine themselves into the surface of the strap. Even if the weakening of the strap material, which is invariably associated therewith, in practical terms is mostly of no further consequence, the abrasive wear which arises in the course thereof is indeed objectionable. This type of issue is avoided in another type of a tensioning installation in which the limit value of tension to be reached is set by means of a friction clutch (U.S. Pat. No. 4,610,076 A). In the case of such a friction clutch there is the issue of reduced reproducibility as a result of wear. Thus, while the abrasive wear as arises in the first mentioned solution is indeed avoided, uniform quality of strap tension does suffer in this case.

SUMMARY OF THE INVENTION

An aspect of the invention is based on an object of providing an improved portable tool which achieves a more precise adherence of the desired strap tension, specifically also at high operating speeds.

A solution according to the invention lies in a tool having the features broadly described below. Advantageous refinements are described in the detailed embodiments below.

In a portable tool for tying an object, in particular the cable harness, by means of a strap, said portable tool having a tool body with a cycle controller disposed therein, and a tensioning installation and a drive therefor, it is provided according to the invention that the drive, as a dual drive, is embodied in such a manner that the cycle controller and the tensioning installation each have a dedicated drive, each drive being independently actuated by a control installation.

An aspect of the invention is based on the concept of providing one dedicated drive each for the cycle controller, on the one hand, and for the tensioning installation, on the other hand. Thus, by providing a dedicated drive for the tensioning installation, this drive is free of interferences caused by the cycle controller. More precise tensioning by means of the tensioning installation may thus be performed. The desired strap tension may be more accurately achieved in this way such that the fastening quality is improved. The result of the tying procedure is thus a secure fit having high reproducibility in terms of the strap tension. A torque-control installation for the drive of the tensioning installation is preferably provided. Said torque-control installation enables precise monitoring of the torque acting on the tensioning installation and thus also of the strap tension caused thereby. The actually achieved strap tension may thus be checked in real time during tensioning. On account thereof, reproducibility is further enhanced. Furthermore, such torque control enables rupture identification. A rupture is characterized in that a rise in the torque of the tensioning installation is followed by a rapid drop, since there is no longer any strap tension as a result of the strap rupture. Process reliability is significantly enhanced by such rupture identification.

A synchronous controller which expediently has such a torque-control installation is preferably provided for the two drives.

The drive of the tensioning installation advantageously comprises a non-return device. It is prevented therewith that in the case of unfavorable conditions as may arise in particular when tying elastic materials an undesirable return movement of the strap may arise. The non-return device may be embodied as a worm gear pair in the drive.

A current monitoring module for an electric drive of the tensioning installation is expediently provided. By way of such current monitoring the torque exerted by the drive of the tensioning installation may be monitored in a particularly efficient manner. This renders mechanical sensors for determining torque superfluous. Rupture identification may also be advantageously integrated in such current monitoring.

The tensioning installation is preferably embodied such that the former acts on the strap in a form-fitting manner by means of a blunt tensioning wheel. In this context, "blunt" is understood to mean that the tensioning wheel does not have any teeth which cut into the strap and in particular do not machine themselves into the strap when the desired strap tension has been reached. Rather, the teeth engage in a form-fitting manner into the correspondingly shaped complementary surface of the strap, much like a gear wheel engages in a timing belt. In this way, a secure grip on the strap is achieved, thus causing reliable coupling of the strap to the tensioning installation and torque monitoring. Process quality and thus reproducibility of strap tension are further improved in this way.

Transducers for an actual revolution speed are expediently disposed on the tensioning installation and on the cycle controller. The actually achieved operating speed may be detected and transmitted to the control installation in this way. The control installation is preferably configured for setting a fixed correlation between the revolution speeds of the cycle controller, on the one hand, and of the tensioning installation, on the other hand. Reliable synchronizing of the procedure is achieved in this way, reproducibility and reliability of the tying procedure being further enhanced on account thereof.

The controller advantageously has a characteristic-curve module which is configured for setting various characteristic curves for revolution speeds/torque. This enables tensioning procedures of variable force or speed, respectively, to be carried out (depending on the cycle time) by way of selection of the characteristic curve. The characteristic-curve module expediently comprises a lookup table which in particular may contain the corresponding parameters for various tensioning forces and speeds (cycle times) in the form of a matrix. Revolution speed correlations for tensioning procedures at various force levels (for example force levels 1 to 5) and for various quality ratings (for example 1 to 3) may thus be stored. Such a parameter matrix makes it possible for the user to upload a matching set of parameters to the control installation in a simple and reliable manner, depending on the type of application.

It is particularly preferable for the control installation to furthermore comprise a dynamics module. The latter is configured for decelerating the tensioning drive in a selectable portion, preferably in the last portion, of the tensioning procedure. This enables the procedure to be carried out more slowly in the particularly critical moment at which the set strap tension is achieved, so that undesirable dynamic effects by virtue of an excessive strap speed are reduced. Reproducibility is further enhanced in this way.

Thanks to the separation according to the invention of the drives of the cycle controller, on the one hand, and of the tensioning installation, on the other hand, this may be performed without the deceleration of the tensioning drive leading to a deceleration of the cycle controller, which per se is undesirable. To this extent, the dynamics module is capable of cancelling in a controlled manner the correlation between revolution speeds, the latter per se being fixed. In this way, an improvement in tying quality and reliability is achieved without potentially having to pay the price of a prolonged cycle time.

The portable tool furthermore preferably has a storage installation which comprises data sets relating to maximum current, average current, holding time, and/or cycle time of the tensioning procedure. A capability of documenting the tensioning procedure is achieved in this way. Since, thanks to the separation according to the invention of the tensioning drive from the cycle controller, the current input by the tensioning drive serves exclusively for tensioning the strap, a capability for documenting may be achieved in this way in an expedient and efficient manner by way of simple measurement of the current input of the tensioning installation. Interference factors by virtue of other procedures of the cycle controller, for example by virtue of friction on the strap, thus do not have any interfering effect. A meaningful documentation of high quality may thus be achieved in a startlingly simple manner. In this way, tying quality is rendered traceable and may be evaluated in the context of measures which per se are usual in the industry, for example in the context of statistical process monitoring. This may also be performed in a localized manner in the context of rupture identification on the strap by the respective control installation.

The data sets which are stored in the storage device may also be provided for external subsequent processing. To this end, an interface by way of which the data sets may be read from the storage installation and supplied to a process monitoring unit is expediently provided.

BRIEF DESCRIPTION OF THE DRAWINGS

The invention will be discussed in more detail hereunder with reference to the appended drawing and by means of an exemplary embodiment. In the drawing.

DETAILED DESCRIPTION OF THE INVENTION

Figure 1:
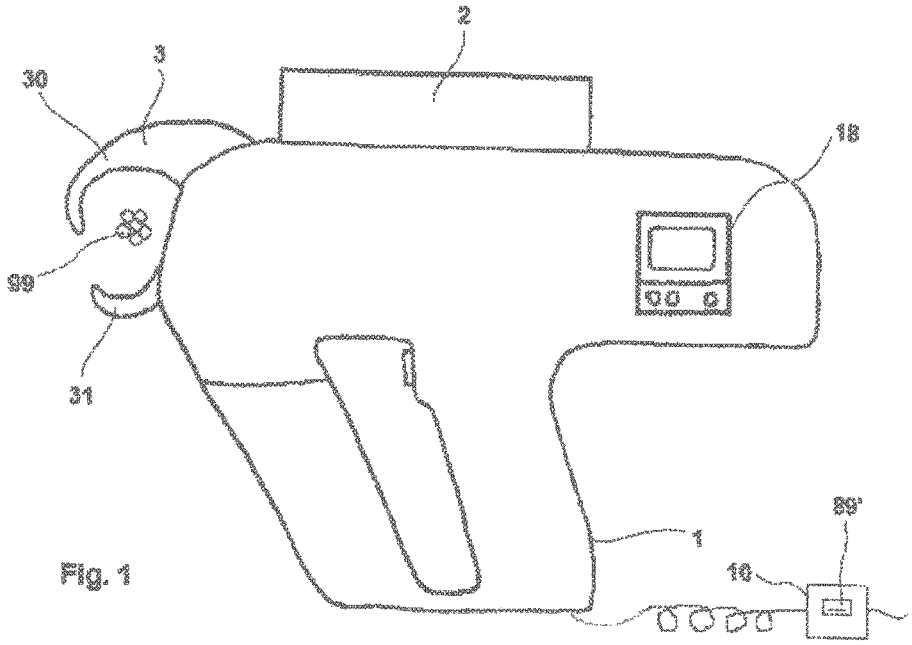
FIG. 1 shows a side view of a portable tying tool.

A portable tying tool in the illustrated exemplary embodiment is provided for processing cable ties 3. The tying tool comprises a tool body 1 having at the lower end thereof a pistol-type handle. A removable magazine 2 is provided at the upper end of said tool body 1, said magazine 2 receiving the cable ties 9 to be supplied. A clamp 3, which of two clamp halves 30, 31 which are moveable in relation to one another, is disposed on a front side of the tool body 1. The tool body on the lateral face thereof has a command panel 18 having a display and input keys. A power pack 10 is provided for providing power.

During operation, the object to be tied (cable strand 99) is moved in between the opened clamp halves 30, 31. The clamp halves 30, 31 converge, thus closing the clamp 3. Here, a cable tie 9, by way of the leading free end thereof, is indexed through a guide groove (not illustrated) on the internal side of the clamp 3 and guided around the cable strand 99 in such a fashion until the free end runs back to the tool body again and there enters into a lock which is disposed at the rear end of the cable tie 9. The free end which is guided through the lock is gripped and tensioned, the projecting part of the strap finally being severed and ejected. At the end, the clamp 3 is opened and the cable strand 99 which is bundled by the cable tie 9 may be removed.

Figure 2:
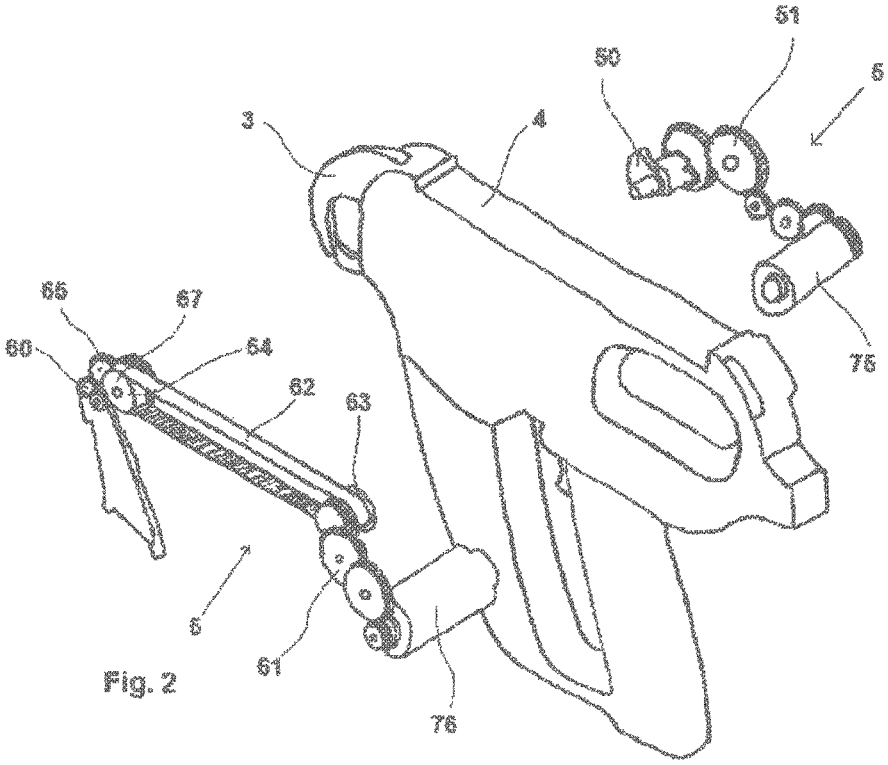
FIG. 2 shows a fragmented exploded view of the tool as per FIG. 1.
Figure 3:
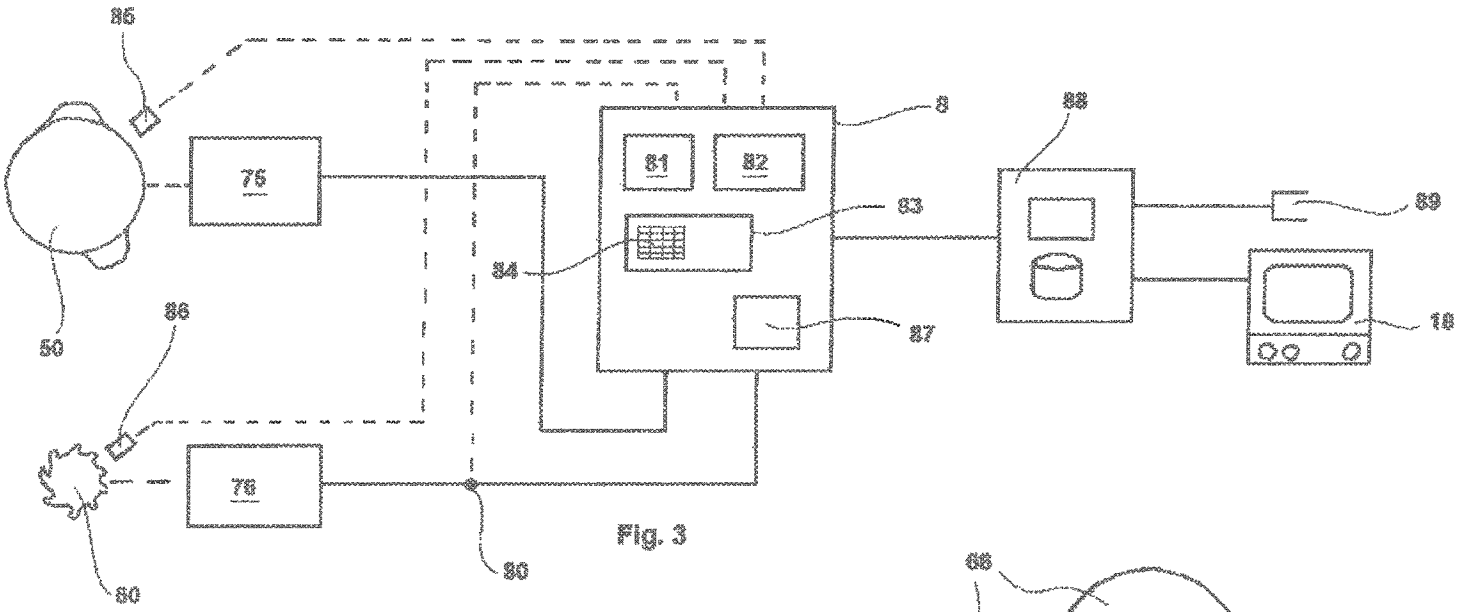
FIG. 3 shows a block diagram for controlling.

In order for these procedures to be effected, a cycle controller 5 and a tensioning installation 6 are disposed in the tool body 1. Together with a chassis element 4 which supports said cycle controller 5 and said tensioning installation 6, the latter two are illustrated in an exploded view in FIG. 2. The cycle controller 5 has a first drive 75 in the form of an electric motor. The latter, by way of a reduction gear which comprises a plurality of gear wheels, is connected to a cam disk 50, so as to drive the latter. A plurality of installations which are not illustrated in detail and which, with the exception of tensioning, carry out the individual procedures stated above (supplying a cable tie, indexing in the clamp, introducing into the lock, severing and ejecting the projecting part) in a controlled sequence are actuated by this cam disk 50.

Figure 4:
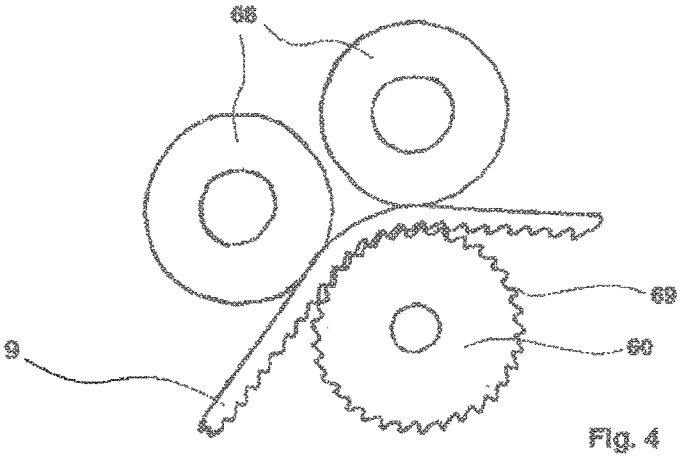
FIG. 4 shows a detailed view of the tensioning roller.

In order for tensioning to be effected, a dedicated tensioning drive 6 is provided according to the invention. In the illustrated exemplary embodiment, the latter is disposed on the chassis element 4 so as to be opposite the cycle controller 5. Said tensioning drive 6 comprised a second dedicated drive 76 which by way of a reduction gear 61 and a timing-belt drive 62 having track rollers 63, 64 at either end. The track roller 64 by way of a reduction gear wheel 65 drives a tension roller 60 which by way of the external circumference thereof grips and indexes the strap of the cable tie 9 (cf. FIG. 4). Two support rollers 66 are disposed opposite the tension roller 60, said support rollers 60 forming a counterbearing to the tension roller 60. The strap of the cable tie 9 is guided through between the tension roller 60 and the support rollers 66. The tension roller 60, on the external circumference thereof, is provided with blunt gripping teeth 69 which engage in a form-fitting manner in a fluting which is provided on the upper side of the strap, thus ensuring functionally reliable indexing and tensioning. Thanks to the form-fitting engagement no slippage arises between the tension roller 60 and the strap 9, thus avoiding the creation of abrasive wear and any weakening of the strap 9.

A non-return device 67 may optionally be provided in the tensioning drive 6 (being integrated in the tension roller 64 in the illustrated example, but being potentially also disposed elsewhere).

The separate drives 75 and 76 are actuated by way of a control installation 8. The latter is configured for synchronizing actuation of the tensioning drive 6 with the cycle controller 5. To this end, a synchronous control module 82 is provided. Signals for the actual revolution speeds of the drives for the cycle controller 5 and for the tensioning installation 6, respectively, which are detected by encoders 85, 86 are applied as input signals. The control installation 8 furthermore contains a torque control installation having a current monitoring module 81 for the drive 76 of the tensioning installation 6. The tension force which is exerted on the strap 9 by the tensioning installation 6 may be determined by measuring the current to the drive 76 by means of a current sensor 80. Once a pre-determined value is achieved, the current and thus the tensioning force is maintained for a specific time, prior to severing of the projecting strap remainder being carried out by the cycle controller, in order to terminate the tying procedure.

In order to be adapted to various types of application, the control installation 8 furthermore contains a characteristic-curve module 83. The latter comprises a parameter matrix 84 which is embodied as a lookup table. Depending on the tensioning force (for example levels 1 to 5), which is selected by way of the command panel 18, and on the desired tying quality (for example ratings 1 to 3), the corresponding set of parameters is uploaded from the matrix 84 and used by the control installation. Depending on the set of parameters another fixed correlation for the revolution speeds of the cycle controller 5, on the one hand, and for the tensioning drive 6, on the other hand, is set. In the case of comparatively high tensioning forces, a higher current is parameterized here for the drive 76 of the tensioning installation, and in the case of comparatively high quality the cycle time is increased, thus reducing the operating speed of the tool.

In order to achieve reliable tying even in the case of small dimensions of the object 99 to be tied also in the case of rather problematic types of application, such as in the case of a low tensioning force at low quality (that is to say in the case of a particularly short cycle time), a dynamics module 87 is provided. The latter, under critical operating conditions such as those outlined above, is configured for carrying out the last portion of the tensioning procedure at a comparatively low speed. Unfavorable dynamic effects by virtue of the operating speed which is high per se (by virtue of the short cycle time) are avoided in this way. Since this reduction in speed is performed in only a comparatively small portion, no appreciable increase in the cycle time results therefrom. Thanks to the drive 76 of the tensioning installation, which is configured so as to be separate, there is no consequential influence on the tensioning force.

A storage installation 88 is connected to the control installation 8. The former stores data sets relating to the tensioning procedures which have been carried out. Said data sets comprise items of information pertaining to the maximum current during tensioning, the average current actually achieved during tensioning, the holding time, and the cycle time. These items of information may be evaluated, for example by means of statistical process control. For external processing, in particular for the purposes of documentation, the data sets may be read by an interface 89. The interface may be disposed on the tool per se or on the power pack 10, for example in the form of a USB socket 89'. Reading may optionally also be performed on the tool per se in that the respective results are called up by way of the command panel 18.

The invention claimed is:

1. A portable tool for tying an object using a strap, comprising:

a tool body;

a cycle controller disposed within the body, said cycle controller having a first drive motor interconnected by a first plurality of gear wheels to a cam disk, said cam disk configured to actuate a sequence of actions; and a tensioning installation having a second drive motor interconnected to a pair of track rollers by a belt and a second plurality of gear wheels, wherein the first and second drive motors are independently actuated by a control installation.

2. The portable tool as claimed in of claim 1, comprising a torque-control installation for the second drive motor.

3. The portable tool as claimed in of claim 1 comprising a synchronous control installation for the first and second drive motors.

4. The portable tool of claim 1, comprising a current monitoring module for the second drive motor.

5. The portable tool of claim 1, wherein the tensioning installation has a tensioning wheel which is configured for engaging the strap in a form-fitting manner.

6. The portable tool of claim 5, wherein the tensioning wheel is configured for engaging in the strap using blunt teeth.

7. The portable tool of claim 1, wherein transducers for an actual revolution speed are disposed on the cycle controller and on the tensioning installation.

8. The portable tool of claim 7, wherein the control installation is configured for setting a fixed correlation between the revolution speeds of the first and second drive motors.

9. The portable tool of claim 1, wherein the control installation has a characteristic-curve module which is configured for setting various characteristic curves for revolution speeds/torque.

10. The portable tool of claim 9, wherein the characteristic-curve module comprises a lookup table.

11. The portable tool of claim 10, wherein the lookup table comprises a parameter matrix for various tensioning forces and speeds.

12. The portable tool of claim 1, wherein the control installation comprises a dynamics module which is configured for decelerating the second drive motor in a selectable portion of a tensioning procedure.

13. The portable tool of claim 12, wherein the dynamics module is configured for decelerating the second drive motor in a last portion of the tensioning procedure.

14. The portable tool of claim 1, comprising a storage installation comprising data sets relating to maximum current, average current, holding time, or cycle time of the tensioning procedure is provided.

15. The portable tool as claimed in of claim 14, wherein the storage installation comprises an interface for external subsequent processing.

16. The portable tool of claim 15, wherein the interface is disposed on the tool or on an external component.

17. The portable tool of claim 15, wherein the interface is disposed on a power pack.

* * * * *